United States Patent [19]

Bartholomew

[11] 4,223,870

[45] Sep. 23, 1980

[54] BAILER FOR TOP HEAD DRIVE ROTARY WELL DRILLS

[76] Inventor: Lynn Bartholomew, Rte. 4, Box 326, Spokane, Wash. 99204

[21] Appl. No.: 33,548

[22] Filed: Apr. 26, 1979

[51] Int. Cl.[3] ..... B66C 23/60

[52] U.S. Cl. ..... 254/334; 254/361

[58] Field of Search ..... 254/139, 139.1, 172, 254/175; 212/60–65, 92, 144, 145; 175/422; 414/1 BD, 1 P, 1 PA, 3

[56] References Cited

U.S. PATENT DOCUMENTS

| | | | |
|---|---|---|---|
| 1,470,377 | 8/1938 | Neff | 254/139 |
| 3,779,135 | 12/1973 | Sugimura | 60/413 X |
| 3,912,227 | 10/1975 | Meeker et al. | 254/172 |
| 4,005,851 | 2/1977 | Plote | 254/139 |

*Primary Examiner*—Leonard D. Christian
*Attorney, Agent, or Firm*—Wells, St. John & Roberts

[57] ABSTRACT

A bailer mounted to the derrick of a top head drive well drilling rig. The bailer includes a winch line drum mounted by a bracket to the derrick. A positive displacement hydraulic motor mounts one end of the drum and receives fluid under pressure from the existing hydraulic pressure supply. Valving is provided to allow reverse operation of the motor so equipment can either be raised or lowered relative to the derrick. The hydraulic delivery line to the motor includes a one way restrictor that will allow relatively free passage of fluid to the motor in a driving or lifting mode but will reverse flow of fluid from the motor, thereby affording a braking effect for lowering a load at a selected rate.

8 Claims, 5 Drawing Figures

BAILER FOR TOP HEAD DRIVE ROTARY WELL DRILLS

BACKGROUND OF THE INVENTION

The present invention relates to bailer lines for top head drive rotary well drills.

Three current types of well drilling apparatus are currently in predominant use for ground water drilling. They are the cable drive, the rotary table drill, and the top head drive rotary drills. All three forms are usually mounted to a truck frame and include a pivoted derrick. The derrick will move between a horizontal transport position and an upright operating position.

The cable drive drilling rig includes a drilling tool that is suspended by an elongated cable. The upper end of the cable is usually connected to a winch and a walking beam arrangement that will alternately raise and drop the drilling tool. The well bore is formed by impaction of the drill tool against the ground surface. Operation of cable drive drilling rigs requires a great amount of skill in timing of the impaction strokes, especially as the drilling tool bores deeper into the earth.

The cable tool drilling rigs inherently include "bailers" as well as other auxiliary winch-hoist arrangements that are generally driven mechanically. However, cable tool drilling rigs are presently outdated by the faster and easier-to-operate rotary drills. Additionally, cable tool rigs are primarily mechanically driven and modern auxiliary hydraulic equipment may not be added without extensive modification and further complication of the working mechanics.

A more modern development in well drilling equipment is the rotary drive drill utilizing a "table drive". The rotary drive drills include rotary drill bits at downward ends of elongated rigid steel drill strings. The drill strings are rotated at the drilling rig and progressively lowered as the rotating bit operates. Sections of the drill string are added at regular intervals while the well is being bored and are removed in sections as the drill string is raised.

The table drive rotary drill includes an upright derrick and a drive unit at the derrick base. The drive unit is termed the "table" and is powered to rotate an elongated upright "kelly". The kelly is generally of polygonal cross section and vertically movable within the table drive. The lower end of the kelly is connected to the upper end of the drill string and is simultaneously rotated and forced downwardly to feed the drill string down the hole and produce pressure on the boring head. After the top end of the kelly reaches the table, the entire drill string must be hoisted with the kelly to bring the top of the drill string to the table level. The drill string is then gripped so the kelly can be removed. A new drill string section is then attached to the string which is again lowered. The kelly is then connected to the top end of the new section. These steps are repeated until the well bore is completed.

Well casing, a continuous pipe placed in the drilled hole to hold the sidewalls from caving in and to keep the well sanitary, is placed in a separate operation after the well hole has been completed. This involves removing the drill string and tool from the hole and successively lowering jointed casing sections down the hole to the bottom.

A solution to the slow operation of the cable drive drill rigs and in many instances the table drive rigs, is the "top head drive" drill rig. The distinguishing characteristic of the top head drive from the table drive is provision of a vertically movable "top head" drive mechanism that moves vertically along the derrick to attach and move with the top end of the drill string. No kelly is required and the position of the top head over the bore opening allows for simultaneous insertion of drill casing as the hole is being bored. Therefore, a top head drive rotary drill can operate significantly faster than table drive or cable drive drilling rigs.

One difficulty with top head drive drilling rigs occurs in areas where sandy soil is prevalent. Loose sand or mud can partially fill a drilled hole even though the hole has been simultaneously lined with casing. The hole must therefore be cleaned and a sand screen placed before a pump can be set.

An effective and proven method of cleaning sand or other debris from a drilled hole is through use of the "sand line". An elongated, hollow bucket is lowered by cable down the hole. The bucket has a hinged flap on the bottom that will open up into the bucket but will not open downwardly. Impact of the bucket with the sand causes the flap to open and sand will fill the interior. The bucket is then lifted. The flap will close under the weight of the sand above and can be raised to the surface and dumped. The bucket is generally connected to a bailer on the derrick or frame of the drill rig for accomplishing this function.

Bailers have not been standard items supplied with top head drive drilling rigs. The mechanism of the drive head and components for raising it up and down the derrick inhibit the use of a bailer line. Furthermore, it is reasoned that where a hole can be lined simultaneously with the drilling process, there is no need or use for a bailer. However, the loose sand situation as described above is only one in which a bailer provided on a top head drive derrick would be useful indeed. Known forms of bailers for cable drive and table drive rigs are extremely slow, underpowered, and both bulky and complex in nature. Table drive bailers are typically driven by a nonpositive displacement hydraulic motor coupled to a mechanical gear reduction unit. Two hydraulic lines must therefore be attached between the hydraulic fluid source and motor. A hydraulic brake must also be supplied for controlling the down hole speed when the bailer is used to lower the equipment down the hole. Such a brake can be effective in controlling lowering speed which is a considerable problem with heavy equipment. Without some form of speed reduction mechanism, increasing down hole speeds can overcome the braking effect of a nonpositive displacement motor. This results in free fall and damage to the down hole equipment in addition to the bailer components. The problem the hydraulic brake presents, though, is its complexity and the additional requirement of more hydraulic fluid lines and associated control valves to already over-complex hydraulic systems.

Many current top head drive rigs make use of "jib" "hoists" to raise and lower casing and drill sections and, on occasion, to raise and lower equipment down the hole. The typical jib hoist is painfully slow and does not include enough cable to reach the bottom of deep wells. Other resources are usually sought with deep hole situations and when more than one round trip needs to be made up and down the hole (as with the sand bailing example set forth above). When bailing or similar operations are required, either the top head rig is moved and replaced with a cable drive rig (that has a bailer) or a "pump truck" with a pump setting hoist is positioned next to the hole adjacent the derrick. Both alternatives are very inconvenient. The least inconvenient of the two (using the pump truck) at best take the pump truck and its operator away from their intended duties, notwithstanding the mechanical and safety hazards of positioning the pump hoist boom correctly over the well without first moving the drill rig or lowering the derrick. The additional equipment crowded about the bore hole makes operations inefficient to say the least. In addition, the boom of a pump truck is generally substantially shorter than the drill derrick so special arrangements must be made when the pump truck is used to handle drill stem sections, casings, and other apparatus designed particularly for the taller drilling rig derrick.

It therefore becomes increasingly desirable to provide a bailer attachment for existing top head drive drill rigs that will mount to the derrick in an unobtrusive position and that will function to both lift and lower heavy loads along a drill hole with minimal control requirements and with minimal interference with respect to existing hydraulic power supply systems.

It is also desirable to provide a bailer attachment for top head drive drill rigs that includes a direct drive relationship between the bailer drive motor and winch drum to thereby reduce mechanical complication and also reduce the number of hydraulic components, lines, and controls utilized for such an attachment.

DETAILED DESCRIPTION OF A PREFERRED EMBODIMENT

Figures 1, 2:
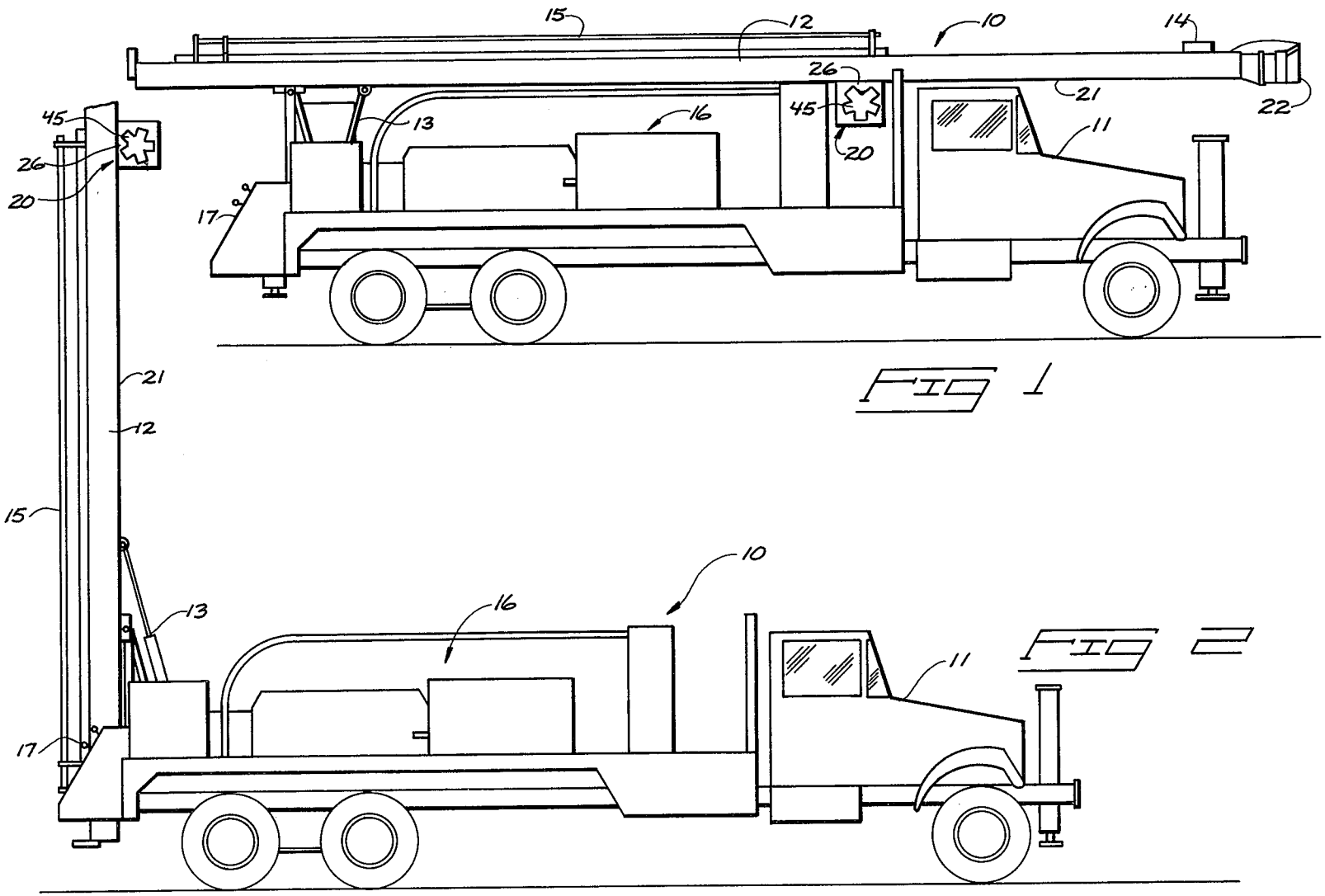
FIG. 1 is a diagrammatic side elevational view of a top head drive rotary well drilling rig.
FIG. 2 is a view similar to FIG. 1 only showing the drilling rig with the derrick in an upright operative position.

A top head drive rotary drill rig is diagrammatically illustrated at 10 in the accompanying drawings. The rig 10 is of the type typically used for ground water drilling. The drilling apparatus is mounted to a conventional heavy duty truck 11 equipped with a rearward frame designed to carry a drilling derrick 12 and associated equipment. The derrick 12 is shown in FIG. 1 in a horizontal transport position and in FIG. 2 in an upright operative position. The derrick 12 is moved between the horizontal and upright positions by a hoist mechanism 13 composed of one or more hydraulic operated cylinders.

A top head drive unit 14 (FIG. 1) is movably mounted to the derrick 12 for the purpose of receiving and turning a rotary drill bit and attached drill string. The drill string is made up of individual sections 15, some of which are carried within a magazine rotatably mounted to the derrick. The top head drive 14 and other driving units utilized by such drill rigs are typically powered by hydraulic fluid under pressure through a power unit 16 that is mounted to the truck frame. Such power units typically include hydraulic pumps, air compressors, pump drive units, hydraulic reservoirs, generators, etc. and typically take up a substantial amount of the limited space available on the truck frame.

The flow of hydraulic fluid and air to the various conventional components is typically controlled by a valving apparatus at a control panel 17. The panel 17 is usually located as indicated in FIGS. 1 and 2, closely adjacent to the lower end of the derrick at the rearward end of the truck.

Figure 3:
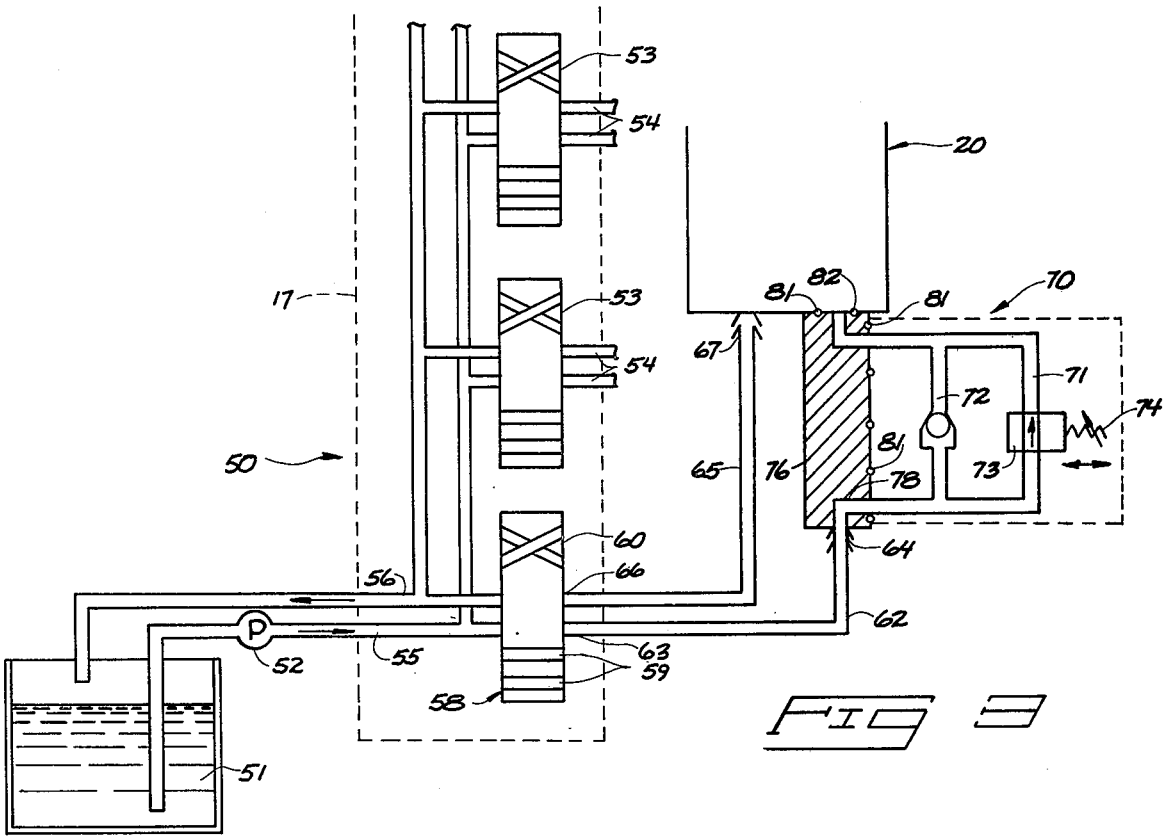
FIG. 3 is a fragmentary pictorial view of the derrick with the present bailer in place.
Figure 5:
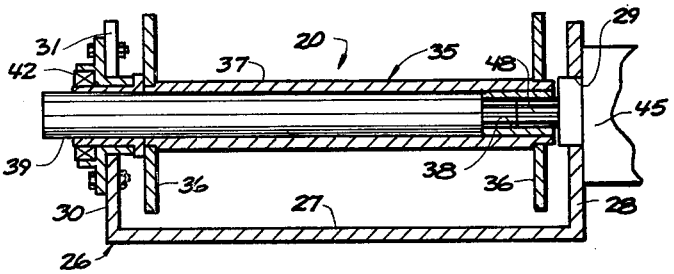
FIG. 5 is a sectional view taken through the bailer, the hydraulic motor not being sectioned.

The present bailer is generally illustrated at 20 in FIGS. 1 and 2 and is shown more specifically in FIGS. 3 and 5. It is situated on the derrick 12 at an inwardly facing derrick side 21. The bailer 20 is spaced downwardly from the derrick top 22 to clear the cab of the truck and other equipment on the truck frame when the derrick is in the inoperative horizontal position.

Figure 4:
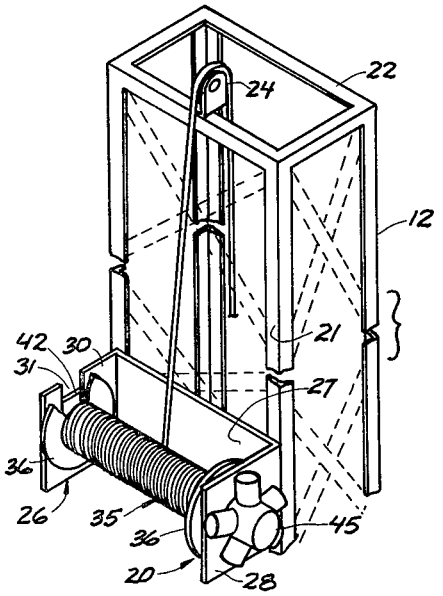
FIG. 4 is a simplified hydraulic schematic of the present combination.

The bailer provides a cable 23 (FIG. 4) that extends upwardly from the bailer over a sheave 24 at the derrick top 22. The cable 23 can extend from the sheave down the derrick and into a drilled hole. The sheave 24 is oriented tangentially to the vertical center line of the derrick (FIG. 3) to prevent rubbing of the cable along the casing walls as the bailer is operated to lift and lower equipment along a drilled hole. Placement of the sheave also permits retraction of the cable to the derrick top 22. The bailer can therefore be used to handle relatively long objects such as drill string sections and casing sections.

The present bailer 20 is mounted to the derrick by a bracket 26 (FIGS. 3 and 5). The bracket is substantially U-shaped and formed of heavy metal plate. It includes a base 27 that mounts flush to the derrick side 21. An outwardly extending bracket side 28 forms one leg of the "U" shape and an opposite side 30 forms the other leg. The side 28 includes a motor receiving hole 29 and the opposite side 30 includes an inwardly extending slot 31. The base of the slot 31 and the center of the hole are substantially coaxial across the bracket.

The bracket 26 rotatably mounts a bailer line drum 35 between the sides 28 and 30 for receiving and playing out the cable 23 (cable 23 is not shown in FIG. 5). The drum 35 is coaxial with the base of slot 31 and mounting hole 29. The rotational axis of the drum 35 is transverse to the derrick and parallel to the rotational axis of the sheave 24.

The bailer line drum 35 includes a pair of spaced end plates 36 held on a central spool or core 37 (FIG. 5). The spool 37 spaces the end plates 36 apart by a distance slightly less than the distance between bracket sides 28 and 30. A spline receiving billet or socket 38 is centered on the drum axis at one end of the drum. A shaft 39 protrudes from an opposing end of the drum to extend through the slot 31. A bearing 42 is mounted on the bracket side 30 to receive and journal the shaft 39 on the bracket.

Bearing 42 is preferably bolted to an outside surface of bracket side 30. Mounting fasteners are thus exposed for ease in removal of the bearing and subsequent removal of the drum from the bracket.

The end of the drum opposite bearing 42 is rotatably mounted by the driveshaft spline 48 of a hydraulic motor 45. The motor 45 is of the positive displacement variety, preferably of the reciprocating piston type. It is mounted to the one side 28 of bracket 26 and extends through mounting hole 29 to connect directly with the winch line drum 35. The spline 48 is provided at the end of a single output shaft for the motor 45. The spline is slidably received within the complementary billet 38 of the winch line drum as shown in FIG. 5. The spline and drum can thus be separated simply by moving the motor and drum axially apart.

The motor 45 is operated by hydraulic pressure through a hydraulic system 50 (FIG. 3). The hydraulic system 50 is adapted for connection into the existing power unit 16 of the drill rig. The conventional system typically includes a reservoir 51 (FIG. 3) that holds a supply of hydraulic fluid in reserve for one or more pumps 52. It is not unusual for a top head drive drilling rig to have several hydraulic pumps operating simultaneously for different purposes. Flow from the pump or pumps 52 is controlled at the panel 17 through a series of flow control valves 53 commonly termed "stacker" valves. Lines 54 from the valves 53 extend to the various components to selectively receive pressurized hydraulic fluid from an associated motor. Common delivery lines 55 and return lines 56 interconnect the pump or pumps 52, control valves 53 and the reservoir 51.

A valve means 58 is included for the hydraulic motor 45 that may be situated on the control panel 17 in relation to the remaining flow control valves 53. The valve means 58 may be comprised of a standard three position selector valve openly connected to the main delivery and return lines 55 and 56 on one side thereof. A straight through section 59 of the valve means 58 will allow normal circuitous flow of hydraulic fluid to the motor 45 while a cross over section 60 provides for reverse flow.

A hydraulic fluid delivery line 62 extends between the valve means 58 and the motor 45. It leads from an end 63 connected to the valve 58 to an end 64 that is operatively connected to the motor. A return line 65 also extends between the motor 45 and valve means 58. The return line 65 leads from an end 66 connected to the valve means to an end 67 connected to the motor 45. The lines 62 and 65 deliver and return fluid through the valve means 58 from and to the pump 52 and reservoir 51. Flow of fluid through the lines is reversed in response to movement of the valve means 58 to bring the cross over section into open communication with the line ends.

A one way flow restrictor 70 is located between the delivery line end 64 and motor 45. The restrictor 70 is shown in schematic form by FIG. 4. It includes a flow through branch 71 and a reverse flow restrictor branch 72. Flow is controlled through the restrictor by a spool or shuttle 73. Selective adjustment of pressure required to move the spool or shuttle between operative and inoperative positions is provided through an adjusting mechanism 74. Reverse flow of fluid through the device will, after a selected back pressure builds up, shift the shuttle 73 to open the restrictor branch 72 and allow restricted flow of fluid in a reverse direction.

A manifold means 76 is provided to directly mount the restrictor 70 to the manifold of the motor 45. A single hydraulic connection to the delivery line is therefore all that is required for connection between the motor and valve means 58. The manifold means 76 is basically comprised of a block secured to the motor by elongated mounting bolts (not shown). A first passage 78 extends partially through the block to receive and mount the delivery line end 64. The opposite end of the passage 78 leads directly into the restrictor 70. A second passage 82 extends from the output side of the restrictor 70 to openly communicate with the motor 45. "O" ring seals 81 are provided at the various openings in the block to seal the manifold to the restrictor 70 and motor 45.

The present bailer assembly may be relatively easily mounted to existing top head drive rotary drill rigs. Installation may be initiated by mounting the bracket, winch line drum, and motor to the derrick. This is done firstly by locating a position on the inward derrick side 21 downward of the top 22 so tha bracket and attached elements will clear the truck cab and existing equipment on the frame when the derrick is in the horizontal transport position. The bracket 26 is mounted to the derrick securely by appropriate mounting fasteners (not shown) that will facilitate removal of the bailer for maintenance or repair.

With the motor mounted in fixed position on the derrick, the hydraulic lines can then be accurately measured and connected. The delivery line is connected to the restrictor through the appropriate fitting on the manifold means 76. This line then leads down the derrick to the valve means 58. The return line 65 is similarly connected between the motor 45 and valve means 58. Short tap lines are spliced into the main delivery and return lines 55 and 56 leading from the reservoir and pump to the stack valves. This connection can be made on many existing top head drill rigs at any of several locations, depending upon the output capacity of the associated pump 52. I have found that interconnection with the delivery and return lines to the derrick hoist mechanism 13 is appropriate since the bailer need not be used when the derrick is being raised or lowered, nor is the derrick raised or lowered when the bailer is operating. Therefore, full capacity of hydraulic fluid may be diverted from the hoist mechanism to the motor 45.

The sheave 24 is then mounted to the derrick top. The cable 23 is trained from the winch line drum over the sheave and down the derrick to an appropriate intermediate anchor point. The bailer assembly is then completely installed and ready for operation.

To describe operation of the present invention, a particular working situation will be given by way of example. It is to be understood, however, that the present bailer may be used for a wide variety of other functions for both down hole purposes and above ground operations.

When a situation is encountered where the drilled and casing-lined hole fills partially with loose sand or mud, the present bailer may be utilized to quickly and efficiently operate a sand line arrangement. Firstly, the drill steel is pulled by conventional methods from the drilled hole. A sand bucket (not shown) is then connected to the free end of the cable 23. The operator then switches the valve means 58 to the cross over section 60 so that pressurized fluid is delivered through the return line 65 and returned through the delivery line 62. Fluid flow will begin only after pressure through the return line reaches a prescribed value as set by the adjusting mechanism 74 of the restrictor 70 (for example, 400 psi). When the pressure exceeds the prescribed value, the spool or shuttle 73 will shift and allow restricted flow through the reverse branch 72 of the restrictor.

Reverse flow of fluid through lines 62 and 65 then causes operation of the motor 45 in reverse to play out the cable 23 from the drum 35. The rate of descent, of course, depends on the flow rate of fluid through the motor. The flow rate can be controlled by the usual control mechanism which typically includes regulating the pressure from the pump 52, varying the rpm of the pump driving unit. Similarly, the rate of descent can be slowed by decreasing the flow through the motor and stopped by lowering the pressure of delivered fluid below the prescribed value set by the adjusting mechanism 74.

Preferably, the drum is operated at a relatively high rate of speed to lower the bracket quickly down the hole. The bucket will then drop and sink partially in the accumulated sand or mud at the bottom of the hole and become partially filled. At this time, the valve means 58 can again be operated to bring the section 59 into communication with lines 62 and 65. The motor 45 will then operate to pull the bucket back up the drilled shaft. In this situation, the delivery line 62 receives pressurized fluid and the return line 65 serves its intended purpose to return fluid from the motor back to the main return line 56. The restrictor valve will automatically move its shuttle 73 back to the normal operating position due to lack of back pressure holding it in the reverse flow mode. Free flow of fluid to the motor is therefore allowed through the delivery line, restrictor, and manifold means. Return of fluid through the return lines is unhampered. The motor is therefore caused to operate in a normal forward mode to rotate the winch line drum 35 to gather the cable 23 and pull the bucket up the drilled shaft. The bucket may then be emptied and subsequently returned down the hole to receive the next load.

Combination of the present bailer and the top head drive rotary drill rig provides a full range of operations for the drill rig without requiring additional equipment such as a cable tool rig or a pump truck for performing operations as described above. The present bailer can be easily and inexpensively added to existing top head drive drill rigs by simply mounting the bracket to the derrick and connecting the hydraulic lines to the existing return and delivery lines from the pressure supply systems. The specific hydraulic motor 45 can be selected from a variety of positive displacement motors that, along with the restrictor 70, eliminate the need for supplying a braking arrangement to control down hole speed in the reverse operation mode. Furthermore, the motor 45, being a positive displacement type, may be selected from a variety of such motors that will operate at substantially higher speed and capacity than is provided for other standard forms of winch assemblies. For example, a capacity of 1140 lbs. of lift at a speed of 973 feet per minute is feasible. These features, enabling the single drill rig to perform various operations without assistance, substantially decreases the drilling time in many situatins.

It is to be understood that the above description and attached drawings are given merely byway of example to set forth a preferred form of the present invention. The following claims are given to more specifically define the scope of my invention.

What I claim is:

1. In a portable top head drive rotary drill rig having a derrick and a source of hydraulic fluid under pressure, a bailer device, comprising:

a drum bracket mounted to the derrick;

a bailer drum rotatably mounted to the bracket for rotation about an axis transverse to the derrick;

a positive displacement hydraulic motor mounted to the bracket and having a driveshaft connected to the bailer drum;

hydraulic line means for delivering and returning hydraulic fluid between the source and the motor through a delivery line and a return line;

valve means in the line means operable to selectively reverse hydraulic fluid flow in the delivery line and return line to thereby reverse operation of the motor; and a one way restrictor mounted in the delivery line allowing relatively unrestricted flow of fluid to the motor along the delivery line but restricting flow from the pump when the flow is reversed by operation of the valve means.

2. The combination as defined by claim 1 further comprising:

manifold means directly mounting the restrictor to the motor and providing connector members releasably mounting the delivery and return lines.

3. The combination as defined by claim 1 wherein the one way restrictor includes manual adjusting means for selectively resisting reverse flow of fluid to produce a selected back pressure against operation of the hydraulic motor in a reversed mode.

4. The combination as defined by claim 1 wherein the drive shaft is connected directly to the bailer drum on one side of the bracket and wherein the bailer drum is journalled on one side of the bracket by a bearing on the bracket.

5. The combination as defined by claim 4 wherein the bracket is mounted to the derrick downward from a top end thereof and wherein the device further comprises a sheave at the derrick top for receiving and training a bailer line from the bailer drum over the derrick top and back down the derrick.

6. The combination as defined by claim 1 wherein the bracket is mounted to the derrick downward from a top end thereof and wherein the device further comprises a sheave at the derrick top for receiving and training a bailer line from the bailer drum over the derrick top and back down the derrick.

7. The combination as defined by claim 6 wherein the one way restrictor includes manual adjusting means for selectively resisting reverse flow of fluid to produce a selected back pressure against operation of the hydraulic motor in a reversed mode.

8. The combination as defined by claim 7 further comprising:

manifold means directly mounting the restrictor to the motor and providing connector members releasably mounting the delivery and return lines.

* * * * *